US006109754A

United States Patent [19]

Steele

[11] Patent Number: 6,109,754

[45] Date of Patent: Aug. 29, 2000

[54] ROTATING REFLECTIVE MARKER

[76] Inventor: Rob Steele, 505 Outer Dr., Tecumseh, Mich. 49286

[21] Appl. No.: 09/310,639

[22] Filed: May 12, 1999

[51] Int. Cl.[7] ..... G02B 5/12

[52] U.S. Cl. ..... 359/522; 359/520; 404/9

[58] Field of Search ..... 359/520, 522, 359/527, 531, 532, 547, 551, 552; 116/63 R; 404/9, 12, 16

[56] References Cited

U.S. PATENT DOCUMENTS

| | | |
|---|---|---|
| 2,693,044 | 11/1954 | Roemisch . |
| 2,701,928 | 2/1955 | Keenan et al. . |
| 2,781,017 | 2/1957 | Fuller et al. . |
| 2,797,621 | 7/1957 | Gladen . |
| 2,810,223 | 10/1957 | Fraesdorf, Jr. . |
| 3,073,047 | 1/1963 | Jones . |
| 3,292,569 | 12/1966 | Trigilio . |
| 3,578,840 | 5/1971 | Richards . |
| 3,758,190 | 9/1973 | Douglas . |
| 4,000,938 | 1/1977 | Kirk . |
| 4,077,076 | 3/1978 | Masters . |
| 4,104,614 | 8/1978 | Litman . |
| 4,183,622 | 1/1980 | Malgarin . |
| 4,229,781 | 10/1980 | Hitora . |
| 4,291,365 | 9/1981 | Tandon et al. . |
| 4,364,634 | 12/1982 | Björlund . |
| 4,747,664 | 5/1988 | Slaughter . |
| 5,349,920 | 9/1994 | Koizumi . |
| 5,379,197 | 1/1995 | Conyers et al. . |
| 5,530,633 | 6/1996 | Yuen . |
| 5,731,895 | 3/1998 | Owczarzak et al. . |

*Primary Examiner*—James Phan
*Attorney, Agent, or Firm*—Young & Basile, P.C.

[57] ABSTRACT

A reflective marker is disclosed. The marker comprises at least one rotatable reflective element contained within an interior volume of an at least partially transparent container, such that the at least one reflective element is visible from outside the container. A drive motor is provided for rotating the at least one reflective element within the container to create a visually striking appearance. The drive motor is powered by at least one rechargeable power source; a recharging device is associated with the at least one rechargeable power source and further with at least one photovoltaic cell, the recharging device operative to recharge the at least one rechargeable power source using electricity supplied by the at least one photovoltaic cell.

20 Claims, 3 Drawing Sheets

ROTATING REFLECTIVE MARKER

FIELD OF THE INVENTION

The present invention relates to roadside reflective markers, and in particular to a reflective marker especially well suited for attachment to roadside sign-posts. The reflective marker of the invention includes at least one photovoltaic cell, a rotating reflective element driven by a drive motor, the drive motor powered by a power source rechargeable by recharging means using electricity supplied by the at least one photovoltaic cell.

BACKGROUND OF THE INVENTION

Roadside reflective markers are well known to alert a driver to visually imperceptible or obscured objects, or to call attention to construction sites, upcoming road signs, and the like. Because visibility in periods of darkness (e.g., at night) is important, these markers are made to reflect incident light rays, such as light from automobile headlamps.

There have been introduced over the years numerous types of reflective markers. One kind includes a stationary reflective element. A drawback of stationary reflective markers, however, is that most reflectors only reflect light at small angles of incidence. In the exemplary situation of roadside reflective markers, if an automobile's headlamps are not aligned properly with the reflective marker then light is not reflected back to the automobile. In such circumstances, the reflective marker is practically useless. To address this problem, reflective markers have been introduced having a reflective element rotatable about an axis to provide optimum visibility in 360 degrees of rotation. It is known that the reflective element in such devices may be rotatable by wind, for example from passing vehicles. Roemisch, U.S. Pat. No. 2,693,044, is exemplary. In conditions of no or low wind, however, the reflective element will not rotate and the marker becomes of no more benefit than an ordinary stationary marker. In high wind conditions, conversely, some conventional wind-driven reflectors may rotate too quickly and decrease the eye-catching visual effect of the rotating feature.

Still other reflective markers have reflective elements exposed to the elements, such as taught by Slaughter, U.S. Pat. No. 4,747,664. Exposed reflectors are prone to become damaged, worn, and/or covered with dirt, thereby reducing their visibility.

Other known rotatable reflective markers include electro-mechanical drive means to ensure operability even in conditions of little or no wind. Some types of these known markers require an external power source, such as a conventional electrical outlet. However, an external power source may not be readily available in all circumstances. Still other such electro-mechanical reflective markers use an internal source, such as a conventional, non-rechargeable battery, that must be frequently replaced. Still other devices, such as Malgarin, U.S. Pat. No. 4,183,622, teach the use of solar power. Malgarin specifically discloses a solar beacon having application as an aircraft anti-collision device. The Malgarin device is taught, in one embodiment, to employ a drive motor for rotating the beacon's reflector, the drive motor powered by an array of solar cells. However, this beacon does not operate during periods of darkness.

SUMMARY OF THE INVENTION

Accordingly, it is an object of the present invention to provide a rotating reflective marker which requires power neither from the wind nor an external power source, and which does not require a high maintenance internal power source.

It is a further object of the present invention to provide a rotating reflective marker that can utilize solar power and yet be operable through periods of darkness.

Yet another object of the present invention is to provide a rotating reflective marker which can operate for long periods of time without the need for maintenance or replacement of the power source.

Another object of the present invention is to provide a rotating reflective marker having certain components thereof, for instance the reflective element, protected from the environment.

Still another object of the present invention is to provide a reflective marker that can be easily attached to conventional sign-posts.

These and other objects and advantages of the present invention are achieved by a rotating reflective marker comprising: An at least partially transparent container defining an interior volume; at least one rotatable reflective element, the reflective element disposed within the interior volume of the container so as to be visible from outside the container; drive means for rotating the reflective element within the container; at least one rechargeable power source operative to power the drive means; at least one photovoltaic cell; and means for recharging the at least one power source using electricity supplied by the at least one photovoltaic cell. According to one feature of this invention, the recharging means further comprise a charge controller provided in circuit with the drive motor, rechargeable power source, and the at least one photovoltaic cell. The charge controller operates to control recharging of the rechargeable power source with electricity supplied by the at least one photovoltaic cell.

According to another feature of this invention, the container includes both transparent and opaque portions. The reflective element is visible through the transparent portion, while the opaque portion is provided generally opposite the transparent portion to provide a background for improving visibility of the reflective element from certain positions in relation to the device.

According to another feature of this invention, the rotating reflective element comprises at least one surface having both reflective and non-reflective areas, so as to create a visually striking appearance as the reflective element rotates.

At least one light source operative to illuminate the reflective element may be provided, the at least one light source powered by the rechargeable power source. According to one feature of the invention, the at least one light source is contained within the container.

The present invention is particularly well suited for use as a roadside reflective marker, and according to a further feature the reflective marker is therefore provided with means for mounting the marker to a support structure, such as a conventional sign post. In one embodiment, according to which the present inventive reflective marker may be disposed between two conventional sign posts, these mounting means comprise at least a pair of adapters dimensioned to extend between the sign posts. According to this embodiment, the inventive marker is first secured to the adapters, the adapters then being connected to the sign posts.

According to yet another feature of this invention, the at least one photovoltaic cell is disposed outside of the container. The container preferably includes an opening permitting access to the interior volume thereof, and means are provided for sealing the opening. According to this feature, the sealing means comprise a cover with which the at least one photovoltaic cell is associated. The cover may also comprise first and second mateable halves defining in the mated condition a container for containing each of the drive motor, charge controller, and the power source.

According to another embodiment, the at least one photovoltaic cell may be contained within the interior volume of the container, thereby protecting the photovoltaic cell from adverse weather conditions and accidental or intentional physical damage.

DETAILED DESCRIPTION OF THE ILLUSTRATED EMBODIMENTS

Figure 1:
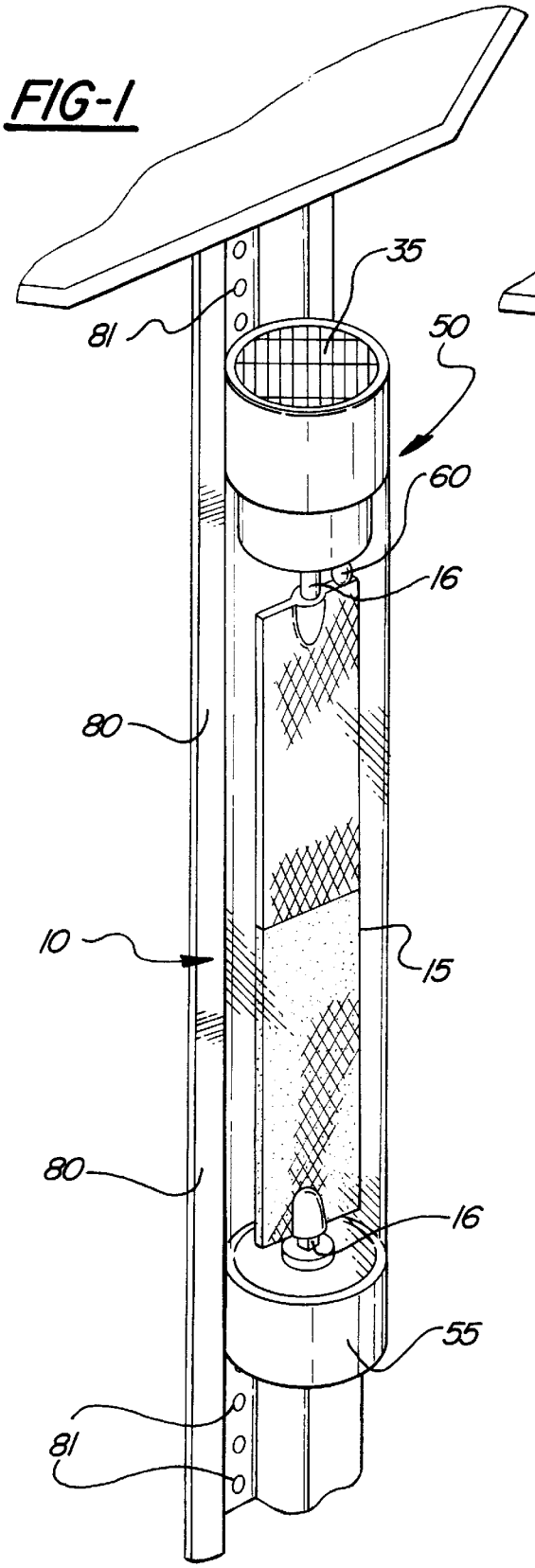
FIG. 1 depicts a quartering perspective view of a first embodiment of the present invention.

Referring now to the drawings, the rotating reflective marker of the present invention generally comprises: a container 10; a rotating reflective element 15 disposed within the container 10 so as to be visible from outside the container; at least one photovoltaic cell, and more preferably an array 35 of such photovoltaic cells; at least one rechargeable power source 30, such as the illustrated battery; means for recharging the power source 30, the recharging means using electricity generated by the at least one photovoltaic cell; and drive means such as the illustrated drive motor 20 and gear-head 25, the drive motor 20 powered by power source 30 and operative to rotate the reflective element 15 about a rotational axis.

In the illustrated embodiment, the present inventive rotating reflective marker is shown mounted to a sign post 80. But while the present invention is particularly well-suited for use in the described environment, and includes inventive means for mounting the marker as shown, it will be understood that the rotating reflective marker of this invention is suitable for use in numerous environments not intended to be limited by the particular description given herein.

Figures 2, 4:
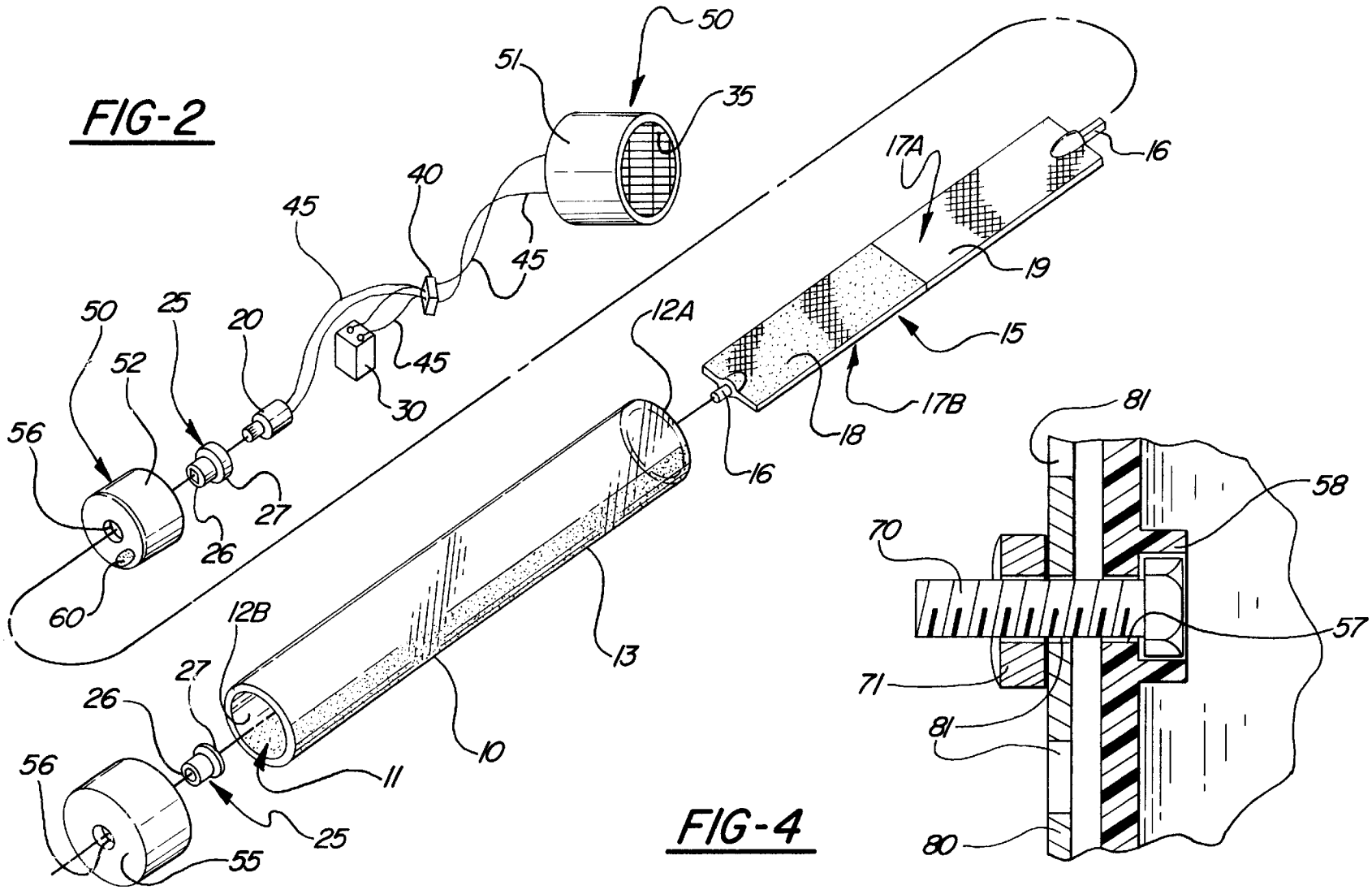
FIG. 2 depicts an exploded view of the invention of FIG. 1.
FIG. 4 depicts a detailed cross-sectional view of the means for mounting the present inventive marker to a sign post or other support structure.

Referring first to FIGS. 1–2, container 10 defines an interior volume 11 for containing, preferably entirely, the reflective element 15 and other components of the present invention, as described hereinafter, so as to protect the same from dirt, weather, or physical damage. Container 10 ideally comprises an at least partially transparent cylinder, as this configuration permits optimal visibility of the reflective element 15 from numerous angles by approaching vehicles, etc. As shown, the container 10 is most preferably opaque 13 over an area thereof; being painted black, for example, so as to provide a background to increase the visibility of the reflective marker 15 to approaching vehicles, etc. Of course, the container 10 need not be limited to cylinder form, and may be fabricated so as to be entirely transparent, or largely opaque, for example; provided that some visibility of the reflective element 15 is enabled. Likewise, container 10 may take any of a variety of geometric shapes, depending upon the desired application or other considerations. One or more openings in the container 10, such as the illustrated first 12A and second 12B open ends, are preferably provided to permit access to the interior volume 11 and the various components of the present invention contained therein, such as may be required for cleaning or maintenance. In the illustrated embodiment, container 10 is fashioned from a durable, weather-resistant polymer, such as acrylic. Other materials suitable to the desired application may also be used. Preferably, the material of container 10 is treated or otherwise fashioned to withstand the ultraviolet radiation so inescapable in the outdoor environment to which the present invention is particularly well suited.

Disposed in interior volume 11 so as to be contained within the container 10 is reflective element 15. The reflective element 15 is dimensioned to be rotatable in container 10 along a rotational axis. Axles 16 disposed along the selected rotational axis are provided to permit rotation of the reflective element 15 as hereinafter described. According to the embodiment shown, the rotational axis of the reflective element 15 corresponds to the reflective element's longitudinal axis. However, other rotational axes may be selected. In the illustrated embodiment, reflective element 15 comprises a rectangularly-shaped piece of material having opposed planar surfaces 17A and 17B. T o provide a visually striking appearance to the reflective element 15, it is preferred that each of opposed surfaces 17A and 17B includes at least one non-reflective area 18 and at least one reflective area 19. In the illustrated embodiment, the reflective area 19 is amber-colored, comprising a reflective material commercially available from Reflexitive North America under the name REFLEXITE AP 1000; the non-reflective area 18 is painted or otherwise colored black. Of course, other reflective materials may be substituted for reflective area 19 as desired. Preferably, the position of the non-reflective 18 and reflective 19 areas is reversed on each of opposed surfaces 17A and 17B, such that during rotation the reflective element 15 displays from any given viewing angle an alternating pattern of non-reflective 18 and reflective 19 surfaces, creating a visually striking effect.

Of course, reflective element 15 need not take the geometric shape illustrated. And it will be understood that any of a variety of combinations and numbers of reflective and non-reflective areas may be provided on the reflective element to render any number of imaginable, visually striking patterns; the areas 18 and 19 illustrated are only exemplary.

Rotation of the reflective element 15 is accomplished via drive means. Drive means preferably comprise a drive motor 20, such as the illustrated low-Amp drive motor commercially available as the MACRO MO 15245; and gear-heads 25, such as the commercially available MACRO MO 15/1 28251. Each gear-head 25 includes a bore 26 correspondingly dimensioned to and receiving therein axles 16. One of gear-heads 25 is operatively associated with and driven by drive motor 20 to thereby effect rotation of the reflective element 15 (FIG. 5); the other gear-head 25 is freely rotating. The driven gear-head 25 ideally rotates at forty-five revolutions per minute, as this has been shown to provide optimum reflective qualities for the reflective element 15 throughout rotation thereof. Other rotational speeds are of course possible, the means to accomplish this being known to those skilled in the art.

The rechargeable power source 30, such as the illustrated Nickel—Cadmium battery, is provided in circuit with and powers the drive motor 20. A photovoltaic array 35 comprising a series of high efficiency photovoltaic cells is associated with the power source 30 via a recharging device, such as the illustrated charge controller 40, available commercially from Eklektix, Inc. in the form of a charge controller/LVD circuit. The charge controller 40 is operative to recharge the power source 30 using energy supplied by the photovoltaic array 35. While any known recharging device may be substituted, the illustrated charge controller circuit is most preferred for its capability to recharge the power source 30 only as necessary and in response to a predetermined drop in voltage of the power source 30 to a voltage greater than 0, rather than, for example, continuously "bleeding" electricity to the power source, or only recharging the power source when it is nearly "dead". The photovoltaic array 35 may be of any number of commercially available arrays, such as the SIEMENS SINGLE CRYSTAL SILICON POWER CELL available from Siemens Solar. Each of drive motor 20, power source 30, photovoltaic array 35, and recharging device 40 are provided in circuit, being connected via electrical wires 45, as shown in FIG. 2. According to the illustrated embodiment, each of the drive motor 20, power source 30, and photovoltaic array 35 are connected to the charge controller.

The power source 30 ideally has enough storage capacity to drive a low amp motor of the type shown for long periods of time, and especially through periods of darkness (e.g., at night) when the photovoltaic array 35/recharging device 40 are not operating to recharge the power source 30.

Depending on the particular components chosen, the rotating reflective marker of this invention may not need service for several months. Using the aforementioned components of the illustrated embodiment, the present inventive reflective marker may operate for up to six months before the rechargeable power source 30 needs to be replaced.

In the preferred embodiment, means for sealing container 10 are provided to protect the components contained therein against the elements. In the illustrated embodiment, these sealing means comprise top 50 and bottom 55 covers which sealingly cover openings 12A and 12B of the container 10. Each cover 50 and 55 is preferably manufactured from a suitably durable material, and may be removably fixed to container 10 by any of a variety of means. In the illustrated embodiment, top cover 50 comprises first 51 and second 52 mateable halves, each half defining an interior volume such that, in the mated condition, first 51 and second 52 halves define a container for containing the driven gear-head 25, drive motor 20, power source 30, recharging device 40, and associated wiring 45 therein in the assembled top cover 50. As shown, second 52 half of the top cover 50 is dimensioned to be receivable within container 10. Both the bottom cover 55, as well as the first half 51 of top cover 50, are dimensioned to be slidingly received over an end of container 10 in snug relation, such that the covers 50 and 55 may only be removed by the application of force. As shown, each cover 50 and 55 includes a bore 56 therethrough in coaxial alignment with the rotational axis of the reflective element 15, each such bore 56 being dimensioned to rotatably receive therein one of the gear-heads 25. Each gear-head 25 includes a radial shoulder 27 of greater dimensions than bore 56, such that the gear-heads 25 may rotate in bores 56 without passing therethrough.

Figure 3:
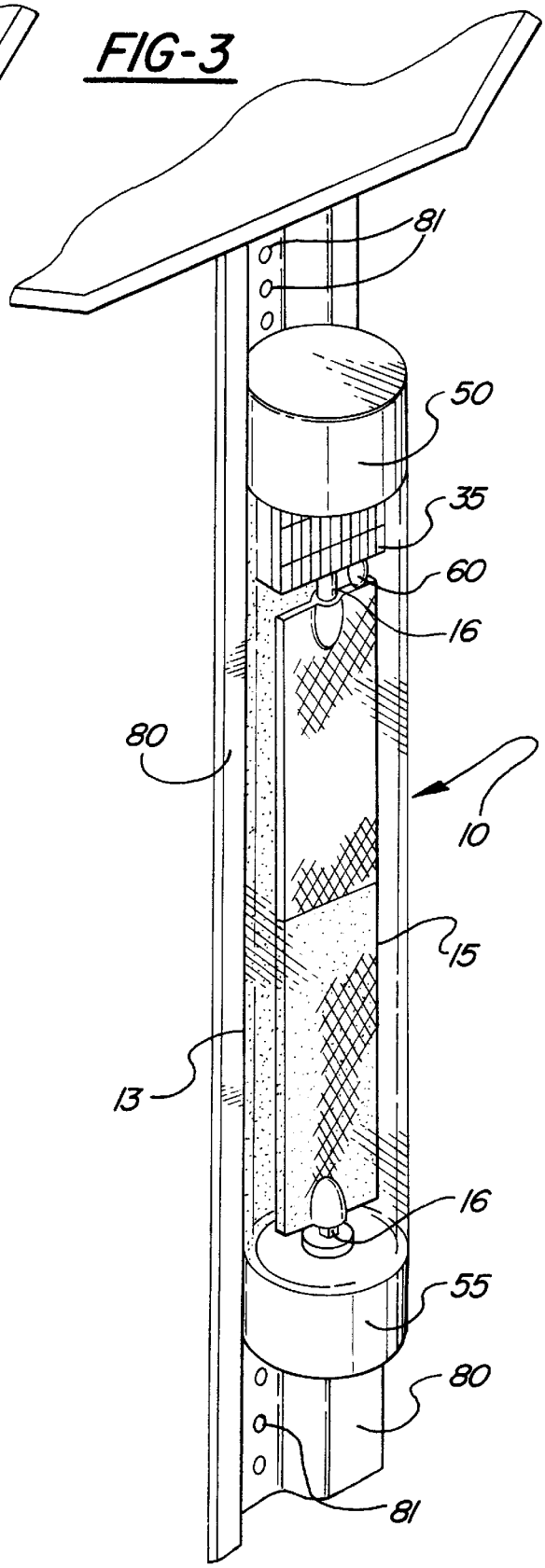
FIG. 3 depicts a quartering perspective view of a second embodiment of the present invention.

According to the most preferred embodiment of the present invention, shown in FIGS. 1 and 2, the photovoltaic array 35 is associated with the first half 51 of top cover 50 so as to be disposed outside of the container 10. This configuration, according to which the array 35 is oriented generally perpendicular to the rotational axis of the reflective marker 15, provides the photovoltaic array 35 with ample exposure to incident sunlight. According to another embodiment, the photovoltaic array 35 may alternatively be disposed within the container 10 as shown. (FIG. 3.) This second embodiment of the present invention is advantageous inasmuch as the photovoltaic array 35 is thereby protected within container 10 from dirt, adverse weather conditions, as well as intended or accidental physical damage.

To provide for additional visibility of the reflective element 15, at least one light source 60, such as the illustrated a low watt halogen light bulb, may be provided. (FIG. 2.) Light source 60 is preferably powered by power source 30, and may accordingly be provided in circuit therewith via electrical wires (not shown) as described elsewhere herein. Light source 60 is most preferably disposed within container 10, the light source being positioned to illuminate reflective element 15 so that the same will serve as a visible marker even in the absence of light provided by automobile headlamps, for instance. In the embodiment of FIGS. 1 and 2, the light source 60 is provided on the second half 52 of top cover 50 as shown. As shown in FIG. 3, the light source 60 may be positioned proximate the photovoltaic array 35 where that array is provided within container 10. Of course, the light source 60, as well as additional light sources, may be positioned within or without container 10 to illuminate the reflective element 15 from numerous directions.

In order to position the present inventive safety reflector in one common operating environment—on road side signs such as "STOP" signs and the like—mounting means are provided. In the illustrated embodiment of FIG. 4, the mounting means comprise a pair of conventional stainless steel bolts 70 receivable through bores 57 provided in top 50 and bottom 55 covers; and non-reversing type nuts 71 threadingly connectable to the bolts. Preferably, each of top 50 and bottom 55 covers includes means for restraining the bolts 70 against rotational movement in order to facilitate threading attachment of the nuts 71. In the illustrated form, these means comprise a wall 58 of corresponding dimensions to the dimensions of the preferably hexagonal head of bolt 70, such means being known to those of skill. These restraining means may be molded into covers 50 and 55 so as to be integral therewith, as shown, or formed according to any other method known to those in the art. Bolts 70 are preferably dimensioned to be receivable through mounting holes 81 of the type found in conventional sign posts 80, such that the present invention may be fastened, for example, to the post of a "STOP" sign or other common road side sign.

Figure 1A:
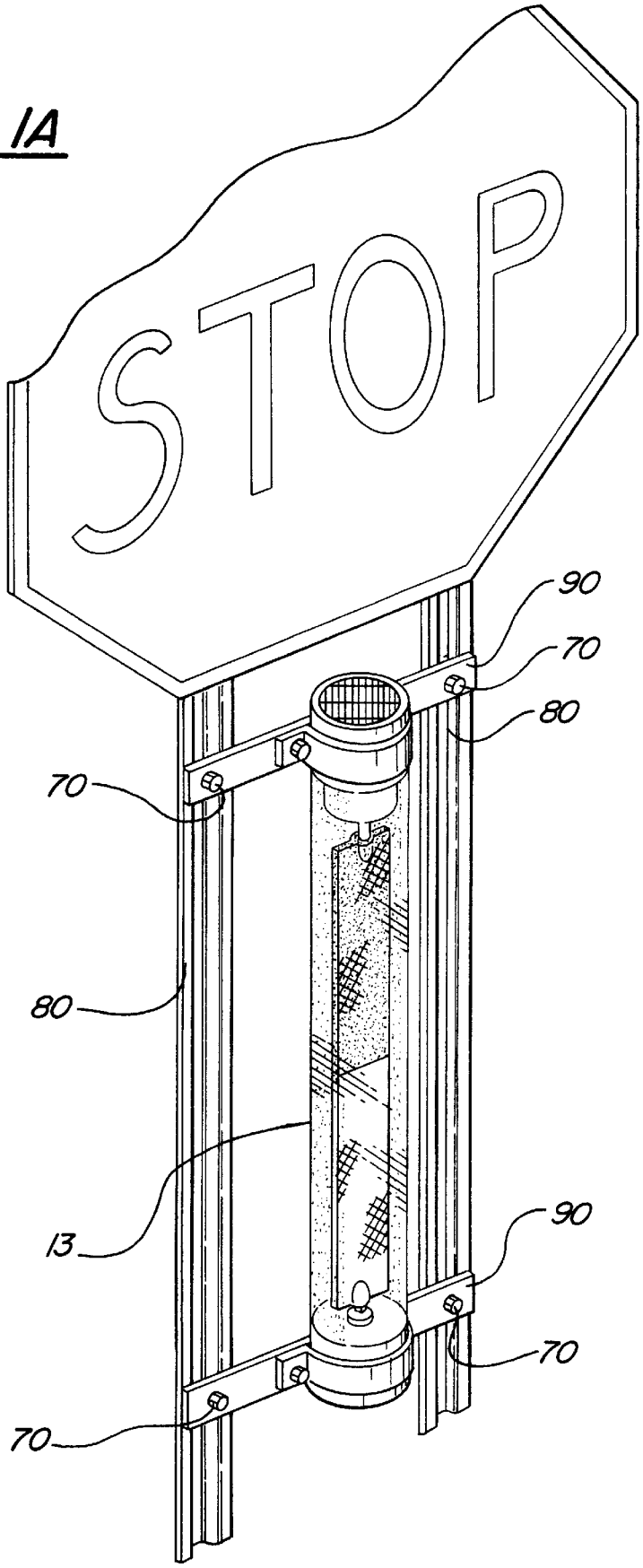
FIG. 1A depicts a quartering perspective view of the invention of FIG. 1 shown in an alternate mounting arrangement.

According to an alternative embodiment of the mounting means, shown in FIG. 1A, a pair of adapters 90 are provided to permit the inventive marker to be secured between two conventional sign posts 80. Each adapter 90 preferably comprises a generally planar length of metal or like material of sufficient dimensions to span the distance between sign posts 80. According to this embodiment, the inventive marker is first secured to adapters 90 by the means described above for securing the marker to a single sign post. (FIG. 4.) Each adapter 90 includes a bore (not shown) proximate each end thereof, each bore receiving a bolt 70 therethrough for mounting to each of the sign posts 80 in the manner heretofore described.

Of course, the foregoing is merely illustrative of only several embodiments of the present invention. Many additions and modifications, apparent to those of ordinary skill in the art, are possible without departing from the spirit and broader aspects of this invention as defined in the appended claims.

The invention in which an exclusive property or privilege is claimed is defined as follows:

1. A reflective marker comprising:

an at least partially transparent container defining an interior volume;

at least one rotatable reflective element disposed within said interior volume of said container, said reflective element visible from outside said container;

at least one rechargeable power source;

a drive motor for rotating said rotatable reflective element within said container, said drive motor powered by said at least one rechargeable power source;

at least one photovoltaic cell; and means for recharging said at least one rechargeable power source using electricity supplied by said at least one photovoltaic cell.

2. The reflective marker of claim 1, wherein said recharging means further comprise a charge controller, each of said at least one photovoltaic cell, said drive motor, and said rechargeable power source being provided in circuit with said charge controller.

3. The reflective marker of claim 1, wherein further said reflective element comprises at least one surface having reflective and non-reflective sections.

4. The reflective marker of claim 1, further comprising at least one light source operative to illuminate said reflective element, said at least one light source powered by said at least one rechargeable power source.

5. The reflective marker of claim 1, further comprising means for mounting said marker to a support structure.

6. The reflective marker of claim 1, further comprising means for mounting said marker between two or more support structures.

7. The reflective marker of claim 6, wherein said mounting means comprise at least one adapter connectable to and spanning the two or more support structures, said reflective marker connectable to said at least one adapter.

8. The reflective marker of claim 1, wherein said photovoltaic array is disposed outside of said container.

9. The reflective marker of claim 8, wherein said container includes at least one opening permitting access to said interior volume, and further including a cover for said opening, said photovoltaic array associated with said cover.

10. The reflective marker of claim 1, wherein said container includes at least one opening permitting access to said interior volume, and further including a cover for said opening, said cover comprising at least first and second mateable halves defining in the mated condition a container, wherein said drive motor and said power source are disposed within said container defined by said at least first and second mateable halves.

11. A reflective marker, comprising:

an at least partially transparent container defining an interior volume;

at least one rotatable reflective element disposed within said interior volume of said container; and provided in circuit: a drive motor for rotating said reflective element, at least one rechargeable power source operative to power said drive motor, at least one photovoltaic cell, and a recharging device operative to recharge said at least one power source using electricity supplied by said at least one photovoltaic cell.

12. The reflective marker of claim 11, wherein said reflective element comprises at least one surface having reflective and non-reflective sections.

13. The reflective marker of claim 12, wherein said container includes at least one opening permitting access to said interior volume, and further including a cover for said opening, said at least one photovoltaic cell associated with said cover.

14. The reflective marker of claim 13, wherein said at least one photovoltaic cell is disposed outside of said container.

15. The reflective marker of claim 14, wherein said cover comprises at least first and second mateable halves defining in the mated condition a container, wherein said drive motor. said recharging device, and said power source are all disposed within said container defined by said at least first and second mateable halves.

16. The reflective marker of claim 11, further comprising at least one light source operative to illuminate said reflective element, said at least one light source provided in said circuit so as to be powered by said at least one rechargeable power source.

17. The reflective marker of claim 11, further comprising means for mounting said marker to a support structure.

18. The reflective marker of claim 11, further comprising means for mounting said marker between two or more support structures.

19. The reflective marker of claim 18, wherein said mounting means comprise at least one adapter connectable to and spanning the two or more support structures, said reflective marker connectable to said at least one adapter.

20. The reflective marker of claim 11, wherein said container includes a transparent portion through which said reflective element is visible, and an opaque portion generally opposite said transparent portion.

* * * * *

UNITED STATES PATENT AND TRADEMARK OFFICE

CERTIFICATE OF CORRECTION

PATENT NO : 6,109,754

DATED : August 29, 2000

INVENTOR(S) : Steele

It is certified that error appears in the above-identified patent and that said Letters Patent are hereby corrected as shown below:

Column 8, line 27, delete "motor." and insert --motor,--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*